United States Patent [19]

Weatherly

[11] Patent Number: 4,639,708

[45] Date of Patent: Jan. 27, 1987

[54] PARALLELOGRAM ELECTRIC COIL HELICALLY WOUND

[75] Inventor: John D. Weatherly, Manurewa, New Zealand

[73] Assignee: Development Finance Corporation of New Zealand, Auckland, New Zealand

[21] Appl. No.: 703,131

[22] Filed: Feb. 19, 1985

[30] Foreign Application Priority Data

Feb. 23, 1984 [NZ] New Zealand ..... 207264

[51] Int. Cl.[4] ..... H01F 27/28

[52] U.S. Cl. ..... 336/200; 29/605; 335/299; 336/225

[58] Field of Search ..... 310/71, 265; 335/213, 335/299; 336/200, 220, 225, 232, 227, 231; 29/602 R, 605

[56] References Cited

U.S. PATENT DOCUMENTS

| | | | |
|---|---|---|---|
| 2,830,212 | 4/1958 | Hanlet | 336/200 X |
| 3,080,541 | 3/1963 | Parker | 336/200 |
| 3,668,571 | 6/1972 | Sato et al. | 310/71 X |
| 3,702,450 | 11/1972 | Avery et al. | 336/200 X |
| 3,726,004 | 4/1973 | Holland et al. | 336/200 X |
| 3,736,543 | 5/1973 | Lademann et al. | 336/200 |
| 4,271,370 | 6/1981 | Di Meo | 336/200 X |

FOREIGN PATENT DOCUMENTS

| | | |
|---|---|---|
| 795469 | 5/1958 | United Kingdom . |
| 1285182 | 8/1972 | United Kingdom . |
| 1459312 | 12/1976 | United Kingdom . |

OTHER PUBLICATIONS

IBM Technical Disclosure Bulletin, "Printed Circuit Coil", J. S. Moreno, vol. 12, No. 6, Nov. 1969, p. 778.

*Primary Examiner*—Thomas J. Kozma
*Attorney, Agent, or Firm*—Young & Thompson

[57] ABSTRACT

An electric coil is printed onto a flexible sheet so that it can be bent into any desired shape to create a complex magnetic field. A flexible parallelogram substrate, having a two-coil pattern printed thereon, can be bent into a cylinder so that the coil pattern at the ends of the cylinder generate an axial magnetic field while the remainder of the coil pattern on the cylinder can generate a transverse field varying continuously through 90°.

5 Claims, 3 Drawing Figures

PARALLELOGRAM ELECTRIC COIL HELICALLY WOUND

BACKGROUND TO THE INVENTION

This invention relates to an electric coil.

In the past, coils have typically been formed of a length of wire wrapped around an axis. An electric current passed through the coil will cause a magnetic field to form around the coil.

If a magnetic field of complex shape is required, then either several coils are required to make up the field, or the coil must be formed in a complex shape. The winding of a complex-shaped field is complicated and expensive, and so the multiple-coil option is often used. This is still several times the expense of a single, simple coil, however.

Coils printed onto a flat circuit board have been used in the past, notably in certain televison circuits. This has been found to be an inexpensive and effective method of forming a magnetic field. Such coils, however, give rise only to simple magnetic fields.

It is an object of the present invention to provide a means of forming a complex magnetic field economically.

SUMMARY OF THE INVENTION

Accordingly, in a first aspect, the present invention broadly consists in a method of forming a magnetic field, the method comprising the steps of printing a coil of conductive material onto a sheet of substantially flexible material, bending the sheet to a desired shape, and passing an electric current through the coil.

Preferably, more than one coil is printed onto the sheet.

Preferably, the coil is printed in the shape of a parallelogram.

Preferably, the sheet is bent into a coil.

In a second aspect, the present invention broadly consists in a coil comprising a substantially flexible sheet and a spiral of conductive material adhered to the sheet.

The above gives a brief description of the invention, a preferred form of which will now be described by way of example with reference to the accompanying drawings.

DESCRIPTION OF THE PREFERRED EMBODIMENT

The drawings show two coils 10, 11 printed onto a flexible sheet or substrate 12. Each coil is a spiral and, in the illustrated embodiment, is in the shape of a parallelogram. Thickenings 13 in the printed line provide convenient electrical contact points. There may typically be two end contacts, a centre contact for connexion to a power supply or the like, and two additional contacts either side of the centre tap for impedance matching purposes.

The coils are typically printed in copper or other conductive material onto a flexible plastics sheet. A preferred material is a flexible epoxy fibreglass sheet.

Figure 1:
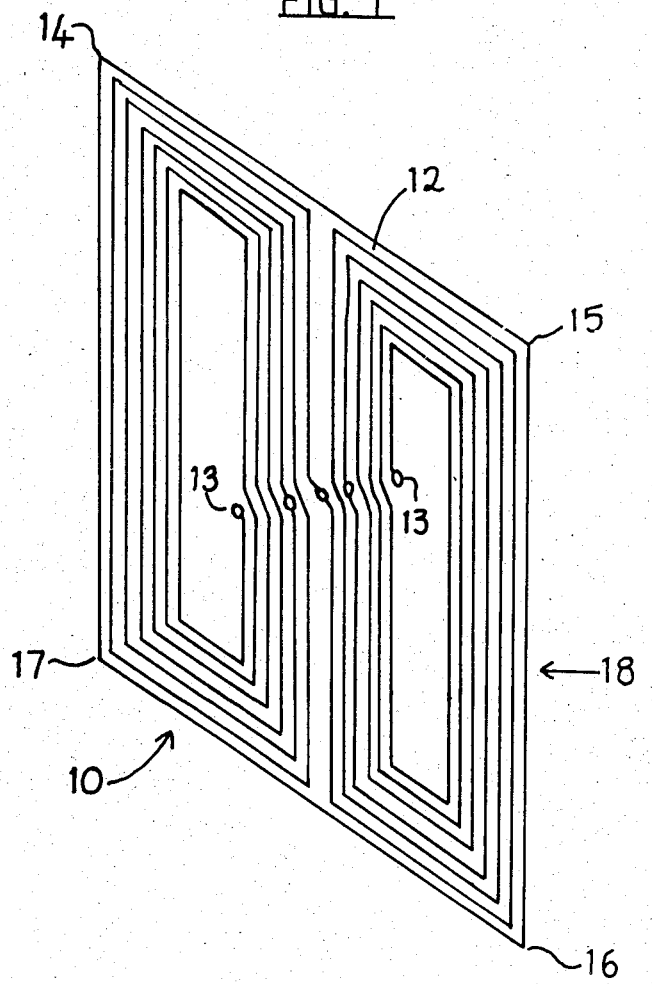
FIG. 1 is a plan view of a coil of the present invention.
Figure 2:
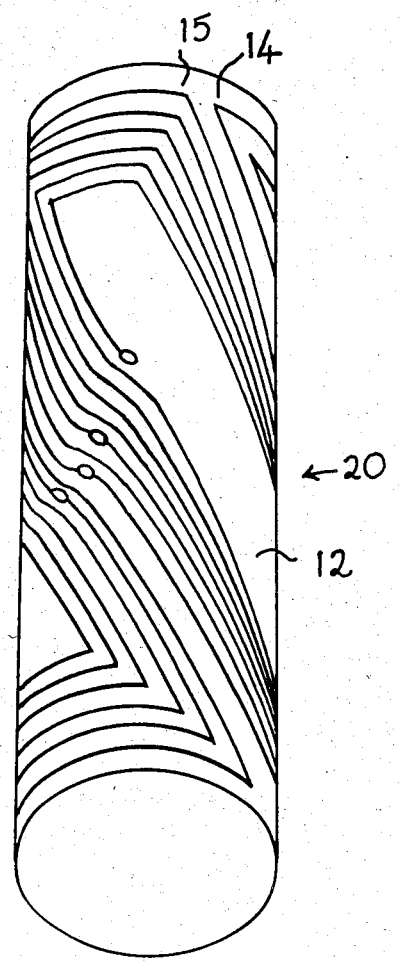
FIG. 2 is a view of the coil of FIG. 1 in an alternative configuration.

In FIG. 2 the sheet 12 is shown curved over to form a cylinder by joining corner 14 to corner 15, and joining corner 16 to corner 17. The cylinder 20 of FIG. 2 is drawn to a large scale than that of FIG. 1. Nevertheless the circumference of the cylinder 20 is the distance along side 14–15 of sheet 10 whilst the length of the cylinder 20 is the distance between corner 15 and point 18 of sheet 10. (Point 18 being opposite to the corner 17).

Figure 3:
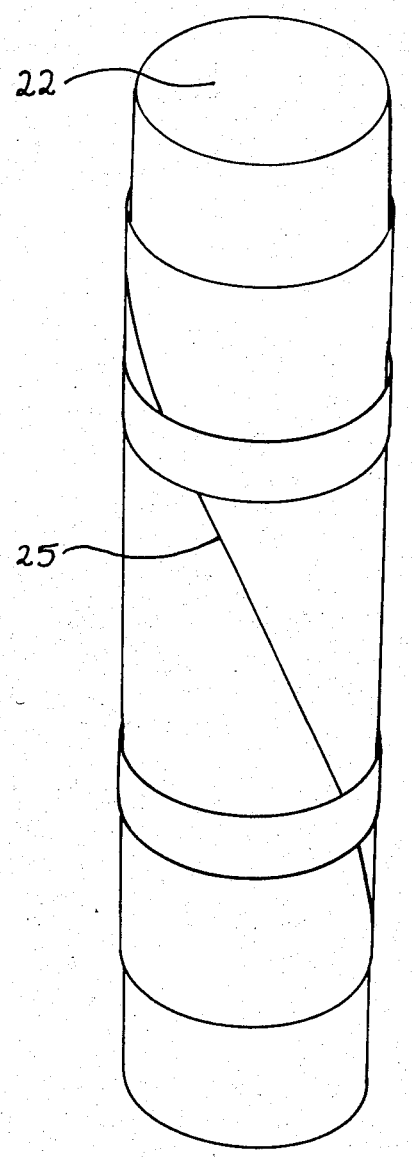
FIG. 3 shows the coil of FIG. 2 secured to a hollow cylindrical core.

It will be generally convenient to wrap the sheet 10 around an electrically insulating hollow cylindrical core 22 (shown in FIG. 3). This may conveniently be a PVC (polyvinylchloride) pipe with the sheet 10 wrapped around the pipe and held in place by straps, or bands, e.g. plastic straps 23, 24 heat shrunk onto the sheet. FIG. 3 also shows on join line 25 between edges 14–17 and 15–16 (the spiral coils have been omitted for the sake of clarity).

If a current is passed between the two end contacts 13 on the sheet, a complex magnetic field suitable for use in the apparatus described in U.S. Pat. No. 4,516,770 is produced. In that specification, the coil is described as being "several coils, or a single coil with taps in a complex pattern". The present invention provides a very simple and effective substitute for the complex coil arrangement of that patent.

In particular, that specification calls for a magnetic field with three axes of magnetic orientation, for detecting the two frequencies of tuned elements within balls rolling through the field. These magnetic axes were in the axial, transverse horizontal and transverse vertical directions. The spiral coil illustrated in FIG. 2 achieves the same affect by using the end windings for the axial component, and the transverse field that varies continuously from horizontal to vertical along the helix from one end of the field to the other.

This removes field discontinuities from the coil, but involves a revised method of ball recognition that determines the ball number after multiple scans as opposed to the scheme described in that specification of having to find both ball frequencies within the same scan. The scan rate is typically about 100 per second.

Various modifications to the above may be made without departing from the scope of the present invention as broadly defined or envisaged. For example, many different coil patterns may be printed onto a sheet in place of the two-coil pattern illustrated. Any pattern of one or more coils may be printed in large quantities very cheaply.

Similarly, a sheet with a coil pattern printed on it can be bent into any desired shape, other than the cylinder described above.

If desired, there may be coils printed on both sides of the substrate, so that they overlap to produce a complex field. Alternatively, two or more substrates may be sandwiched together to achieve a similar result.

Printed coils may, of course, be cut and joined together in different arrangements to achieve different field shapes.

I claim:

1. A cylindrical coil, with electrically conductive elements arranged to create a magnetic field therein, said magnetic field having an axial component and a transverse component, wherein the said transverse component rotates through 90° over at least part of the length of the coil; said coil being formed from a substrate having said electrically conductive elements thereon, said electrically conductive elements comprising at least one spiral of electrically conductive material in the shape of a parallelogram on a planar surface of the substrate, said at least one spiral being in turn wound around the cylinder as at least one helix.

2. A cylindrical coil as claimed in claim 1, said coil being formed from a flat flexible substrate, having said electrically conductive elements printed thereon in the shape of at least one spiral parallelogram, said substrate being rolled to form a cylinder, on which said electrically conductive elements appear as at least one helix.

3. A cylindrical coil, with electrically conductive elements arranged to create a magnetic field therein, said coil being formed from a substrate having said electrically conductive elements thereon, said electrically conductive elements comprising at least one spiral of electrically conductive material in the shape of a parallelogram on a planar surface of the substrate, said at least one spiral being in turn wound around the cylinder as at least one helix.

4. A cylindrical coil as claimed in claim 3, said electrically conductive elements being in the shape of at least one quadrangular parallelogram having two opposite acute angles and two opposite obtuse angles.

5. A cylindrical coil as claimed in claim 4, in which two opposite sides of said at least one quadrangular parallelogram are parallel to the ends of the cylinder and the other two opposite sides of the parallelogram have the shape of helices.

* * * * *